US012492092B2

(12) United States Patent
Valles Casanova et al.

(10) Patent No.: US 12,492,092 B2
(45) Date of Patent: Dec. 9, 2025

(54) MEDIA COLLECTING

(71) Applicant: HEWLETT-PACKARD DEVELOPMENT COMPANY, L.P., Spring, TX (US)

(72) Inventors: Lluis Valles Casanova, Sant Cugat del Valles (ES); Carles Flotats Villagrasa, Sant Cugat del Valles (ES); David Melero Cazorla, Sant Cugat del Valles (ES); Jordi Dalmau Fabregat, Sant Cugat del Valles (ES); Abel Martinez Guillen, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 1183 days.

(21) Appl. No.: 17/375,571

(22) Filed: Jul. 14, 2021

(65) Prior Publication Data

US 2023/0015596 A1 Jan. 19, 2023

(51) Int. Cl.

| | |
|---|---|
| ***B41J 11/42*** | (2006.01) |
| ***B65H 5/06*** | (2006.01) |
| ***B65H 20/34*** | (2006.01) |
| ***B65H 23/188*** | (2006.01) |
| ***B65H 23/192*** | (2006.01) |

(52) U.S. Cl.

CPC ..... *B65H 20/34* (2013.01); *B65H 5/062* (2013.01); *B65H 23/1888* (2013.01); *B65H 23/192* (2013.01); *B65H 2513/11* (2013.01); *B65H 2601/122* (2013.01); *B65H 2601/254* (2013.01)

(58) Field of Classification Search

None

See application file for complete search history.

(56) References Cited

U.S. PATENT DOCUMENTS

| | | | | |
|---|---|---|---|---|
| 2007/0297841 | A1 | 12/2007 | Moore | |
| 2010/0194812 | A1* | 8/2010 | Castells | B65H 18/103 347/104 |
| 2017/0050452 | A1* | 2/2017 | Hamano | B65H 23/1955 |
| 2017/0274688 | A1 | 9/2017 | Hatada et al. | |
| 2020/0262221 | A1* | 8/2020 | Yokozawa | B41J 15/046 |
| 2020/0298436 | A1 | 9/2020 | Giancaterino | |

FOREIGN PATENT DOCUMENTS

WO WO-2020051196 3/2020

OTHER PUBLICATIONS

Ziyu Wang; "Design Decoupling Controller for Rewinding System of the Gravure Printing Machines"; Jul. 16, 2020.

* cited by examiner

*Primary Examiner* — Leslie J Evanisko

(74) *Attorney, Agent, or Firm* — Jordan IP Law, LLC

(57) ABSTRACT

According to an example, a method to wind media in an output roller downstream a media advance engine comprises advancing a medium for a determined medium length, collecting a first portion of the determined medium length at a first speed by rotating the output roller in a winding direction, and collecting a second portion of the determined medium length by rotating the output roller in a winding direction at a second speed, wherein the first speed is greater than the second speed.

6 Claims, 4 Drawing Sheets

MEDIA COLLECTING

BACKGROUND

Printing systems may comprise different types of media collecting mechanisms based on the printing system configuration. Examples of printing system configurations comprise roll-to-sheet configurations, sheet-to-sheet configurations, sheet-to-roll configurations, and roll-to-roll configurations. In some examples, printing systems may be adapted to receive multiple configurations, thereby increasing its loading capabilities.

BRIEF DESCRIPTION OF DRAWINGS

Features of the present disclosure are illustrated by way of example and are not limited in the following figure(s), in which like numerals indicate like elements, in which.

DETAILED DESCRIPTION

Figure 1:
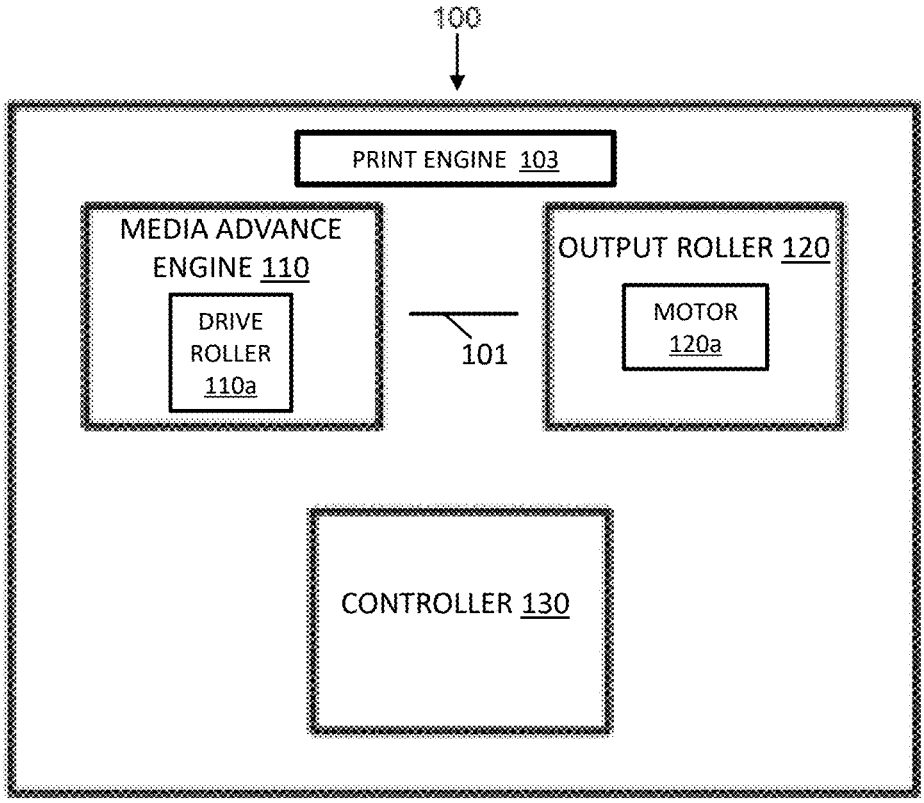
FIG. 1 shows a printing system comprising a media advance engine, an output roller, and a controller, according to an example.

For simplicity and illustrative purposes, the present disclosure is described by referring mainly to examples. In the following description, numerous specific details are set forth in order to provide a thorough understanding of the present disclosure. It will be readily apparent, however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Printing systems use media handling devices to move media from an input region to an output region. In use, a media handling device transports media loaded in the input region towards an output region. In some examples, the loaded media may pass through a printing operation region where an operation (or operations) may be performed over the media. Examples of operations comprise ejecting printing fluid to the media, cutting the media, conditioning the media (for instance, heating, humidifying, or drying the media), among others.

The input region of a printing system may correspond, for instance, with a media tray on which sheets of media are stacked, a media roll having a leading-edge, or an input slot tray where sheets of media are manually inserted by a user of the printing system. Similarly, the output region of the printing device may be, for instance, a tray on which a media is to be stacked after the printing operation (for instance a stacker), a media roll where the media is collected, or a surface suitable to receive a media (for instance, the floor).

Combinations of input regions with output regions result in multiple types of printing system configurations. For example, when a sheet of media is received in the input region and a sheet of media is ejected in the output region, the printing system configuration may be referred to as a sheet-to-sheet configuration. Similarly, if a media roll is received in the input region and a sheet of media is ejected in the output region, the printing system configuration may be referred to as a roll-to-sheet configuration. When a sheet of media is received in the input region and the media is collected in a media roll in the output region, the printing system configuration may be referred to as sheet-to-roll configuration. When a media roll is received in the input region and the media is collected in a media roll in the output region, the printing system configuration may be referred to as roll-to-roll configuration.

In order to collect media as a media roll, printing systems may use output rollers. By rotating the output roller in a winding direction, the media leaving the printing system through the output region is collected. However, such a winding operation may have an impact on the media. When a sheet-to-roll configuration or a roll-to-roll configuration is selected as the printing system configuration, the media collecting operation may result in printing artifacts, media damage, or winding deficiencies.

Examples of deficiencies that users may experience during the media collecting operation comprise wrinkles generated during the media movement, printing fluid smearing, inaccurate media advancement, media skew while the media advances towards the output region, poor winding performance, among others. Winding operations impart tensions over the media that is being collected, and such tensions are transmitted to the portion of media undergoing the printing operation thereby leading to the appearance of winding deficiencies. In an example, one factor that contributes to the appearance of deficiencies is a media collecting speed of an output roller.

In order to collect media in a reliable manner, decoupling methods may be used. Such decoupling methods may reduce the impacts of the winding operation by decoupling an output roller of the printing system with respect to a media advance system of the printing system. Also, systems and computer-readable medium comprising instructions may be used so as to mitigate the issues experienced during media winding operation. In addition, the decoupling methods increase the accuracy and the effectiveness of the winding operation.

Throughout the description, the term "decouple" will be used to refer to the control of the movement of at least one of the media advance engine and the output roller such that a media buffer is generated between them. Therefore, examples of decoupling operations comprise moving the media advance engine while not collecting media on the output roller, moving the media advance engine at a higher speed than the peripheral speed of the output roller, rotating the output roller in an unwinding direction to release media from the output roller, among others.

According to an example, a printing system may comprise a media advance engine, an output roller, and a controller. The printing system may comprise an input region and an output region, wherein the media advance engine is to transport a medium through the printing system. Examples of media advance engines comprise drive rollers, belts, or any other device capable of transporting media through the printing system. Since the output region of the printing system includes the output roller, a configuration of the printing system may correspond to a sheet-to-roll configuration or a roll-to-roll configuration. In the output region, the output roller is to collect the medium by rotating in a winding direction such that the medium is collected around it.

In order to reduce the media deficiencies generated by the media collecting operation, the controller of the printing system may control a movement of the output roller (such as a rotation in a winding direction) to decouple the output roller with respect to the media advance provided by the media advance engine. As a result of the decoupling, a media buffer is created between the media advance engine and the output roller. Due to the presence of the media buffer, the tensions generated by the media collecting operation are not transmitted to the portion of media undergoing a printing operation, and hence, printing deficiencies generated during the printing operation are reduced. Nonetheless, periodic decoupling of the media collecting operation of output roller with respect to the media advance provided by the media advance engine will result in an increase of the size of the media buffer. In order to reduce the size of the media buffer, the controller of the printing system may control the output roller to periodically collect a portion of media from the buffer. The periods may be set, for instance, at a time after a series of print swaths are performed by a print engine or upon a determined media length (for instance fifty centimeters) are advanced. In an example, a portion of the medium is collected during a time in which there is no media advance by the media advance engine. In other examples, a portion of the medium is collected during a time in which the media advance engine advances the medium without performing a printing operation. In some other examples, the media collecting operation may comprise collecting the medium on the output roller of the printing system at two speeds: a first speed and a second speed. At the first speed, a first portion of the medium is collected on the output roller. At the second speed, a second portion of the medium is collected on the output roller. In order to reduce the appearance of deficiencies, the second speed may be set such that no tensions are imparted to the remaining media that is within the printing system, i.e., the second speed may be lower than the first speed in order to keep an admissible throughput while reducing the deficiencies derived from the media collecting operation.

Referring now to FIG. 1, a printing system 100 is shown. The printing system 100 comprises a media advance engine 110, an output roller 120, and a controller 130. Since the printing system 100 comprises the output roller 120, the printing system configuration can correspond either to a sheet-to-roll configuration or a roll-to-roll configuration. In FIG. 1, the media advance engine 110 is to advance a medium 101 towards a print engine 103. The media advance engine 110 may be, for instance, a drive roller 110*a* to engage with the medium in its periphery. The output roller 120, which is downstream the media advance engine 110, is to receive the medium from the media advance engine 110. The controller 130 of the printing system 100 is to control each of the media advance engine 110 and the output roller 120. In an example, the controller 130 is to control the media advance engine 110 to advance the medium for a determined medium length, rotate the output roller 120 in a winding direction at a first speed, and rotate the output roller 120 in the winding direction at a second speed lower than the first speed. The determined medium length may correspond, for instance, with a length associated with a set of print engine swaths or a length associated with a media advance transmitted by the media advance engine 110. In examples where the media advance engine 110 corresponds to a drive roller, the controller 130 is to advance the medium for a determined medium length by a rotation of the drive roller, rotate the output roller 120 in a winding direction at the first speed, and subsequently rotate the output roller 120 at the second speed, the first speed being greater than the second speed. In order to effectively decouple the output roller from the media advance engine, the first speed transmitted by the output roller is lower than a media advance speed generated by the media advance engine. In some examples, the rotation of the output roller at the first speed is, at least, five times higher than the rotation of the output roller at the second speed. However, alternative ratios from the first speed to the second speed may be provided, such as a first speed being ten times higher than second speed, a first speed fifteen times higher than a second speed, among others.

In some examples, the output roller rotation at the first speed collects a first portion of the determined medium length and the output roller rotation at the second speed collects a second portion of the determined medium length. In an example, the first portion is at least two times greater than the second portion such that a larger medium length is collected at the first speed, i.e. the higher speed. However, in other examples, the first portion may be three, four, or five times greater than the second portion. In an example, the first portion is a 75% of the determined medium length. However, in other examples, alternative values may be possible, such as a 70% of the determined medium length, a 60% of the determined medium length, or an 80% of the determined medium length.

In other examples, the printing system 100 may further comprise a print engine to execute a printing operation, wherein the controller 130 is to control the print engine to execute the printing operation on the media during the media advancement provided by the media advance engine 110.

According to some examples, the portions of media collected by the output roller may be determined by a controller of a printing system based on at least one of a media characteristic (such as a media thickness, a media density, a media stiffness), a print mode (such as high-quality plots, a printing speed, pre/post-processing operations), and a media advance distance transmitted by the media advance engine. In other examples, the portions of media collected by the output roller may be determined by the controller based on a print mode and a media characteristic. In some other examples, the portions of media collected by the output roller may be determined based on the media advance transmitted by the media advance engine. When media advance engine corresponds with a drive roller, in order to measure the media advance distance, the printing system may use a speed sensor to determine an angular speed of the driver roller over a time, and based on the angular speed, the system may determine the media advance distance. In other examples, the media advance distance may be determined by using a sensor to measure an angle rotated by the drive roller over a period of time.

Figure 2:
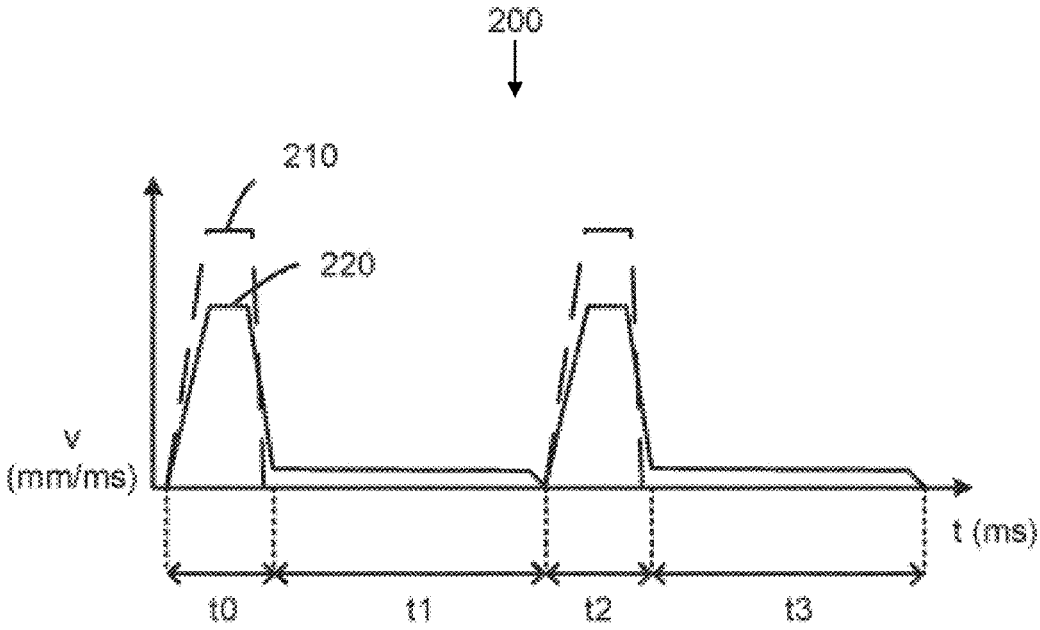
FIG. 2 shows a line chart representing a media advance speed and a media collecting speed over a period of time; according to an example.

Referring now to FIG. 2, a line chart 200 representing a media advance speed 210 and a media collecting speed 220 over a period of time is shown. The Y-axis of the line chart 200 represents linear speeds and the X-axis represents a time. In line chart 200, the dashed line corresponds to the media advance speed 210 that a media advance engine exerts to a medium and the solid line corresponds to the media collecting speed 220 caused by the output roller to collect the medium. Each of the media advance speed 210 and the media collecting speed 220 result in media advance distance and a collected media distance, respectively. In order to perform a media collecting movement 220, the output roller is to rotate at an angular speed (not represented in the line chart 200 of FIG. 2). For illustrative purposes, the line chart 200 illustrates the linear speeds resulting from a rotation of the output roller at determined angular speeds.

In FIG. 2, the horizontal axis is divided in a period t0, a period t1, a period t2, and a period t3. From the period t0 to the period t1, line chart 200 represents a first decoupling operation between the media advance engine and the output roller of the printing system. The first decoupling operation, which is caused by the differences between the media advance speed 210 and the media collecting speed 220 over a time comprised between the period t0 and the period t1 results in a media buffer. From the period t2 to the period t3, line chart 200 represents a second decoupling operation, i.e., a second media buffer is generated.

During the period t0, the media advance engine of the printing system advances the medium for a determined medium length. In order to advance the medium for the determined medium length, the media advance engine accelerates the medium until reaching a steady speed, maintains the steady speed over a period of time, and decelerates the medium until reaching a null speed. As the media advance engine advances the medium for the determined medium length, the output roller rotates in a winding direction to collect a length of the medium from the media advance engine. In order to decouple the output roller with respect to the media advance engine, the output roller collects over the period t0 a first portion of media, the first portion being lower than the determined medium length. To collect the first portion of media, the output roller accelerates until reaching a maximum speed, holds at the maximum speed over a time, and decelerates. The average speed obtained by the output roller over the period t0 may be referred to as the first speed. As explained above, to effectively decouple the movement of the output roller with respect to the media advance provided by the media advance engine, during the period t0, the first portion of media (i.e., the length of the medium collected by the output roller) is lower than the determined medium length (i.e., an advance of the medium transmitted by the media advance engine). The medium length difference between the determined medium length and the first portion results in the first media buffer. In the example provided in FIG. 2, the media advance and the media collecting start substantially at the same time, however, in an example, a delay may be added between the media advance movement and a media collecting movement.

Then, during the period t1, the output roller rotates in the winding direction to collect a second portion of the medium. To collect the second portion, the output roller is rotated at a speed slower than the first speed. The average speed obtained during the period t1 by the output roller may be referred to as second speed. In some examples, the second speed corresponds to a predefined speed which does not result in deficiencies over the media being collected, such as a speed three times lower than the first speed or a speed not exceeding a maximum allowable speed. Based on the type of media being collected, a controller of the printing system may determine a second speed which results in a better winding performance, higher image quality, and less printing artifacts. In an example, the second portion of the medium corresponds to a remaining portion of the medium not collected during the period to, i.e., a portion associated to the first media buffer. In other examples, the second portion of media may be the portion of media associated to the first media buffer minus a predefined portion of the medium, wherein the predefined portion of media is a predefined safety distance to avoid the appearance of deficiencies due to excessive tension. In order to determine that the second portion has been effectively collected, the controller of the printing system may receive a trigger event. The trigger event may be, for instance, an indication that the media collected at the second speed has reached the second portion. In order to measure the media collected, the system may comprise a sensor positioned nearby the output roller to measure the collected media on the output roller. However, alternative trigger events may be possible, such as a motor 120*a* driving the output roller that exceeds a voltage input associated with the end of the collecting operation of the second portion. In other examples, the trigger event may be determined based on a power of a motor driving the output roller, wherein upon the power of the motor exceeds a threshold power, the media collected at the second speed is considered that has reached the second portion.

Once the second portion of the medium has been collected, a second media advancement is performed during the period t2. In addition to the media advance operation performed by the media advance engine during the period t2, the output roller collects a first portion of the second media advance at a lower rate than the media advance transmitted by the media advance engine. The differences between the media advance speed 210 and the media collecting speed 220 result in the appearance of the second media buffer. Then, during the period t3, a second portion of the second media advancement is collected by the output roller such that the remaining media of the second media buffer is collected.

In an example, the determined medium length advanced by the medium may be associated with a length associated with a set of print engine swaths, i.e., the determined medium length is associated with a distance of media printed. However, other alternatives may be possible, such as a determined medium length corresponding with a media advance, i.e., the determined media is associated with a distance that the medium has advanced instead of being associated with a distance of printed media.

In some examples, the media advance engine is a drive roller positioned upstream the output roller, wherein the drive roller and the output roller may comprise different radiuses. Therefore, a rotation at the same angular speed for the drive roller and the output roller may transmit to the media different linear speeds thereby resulting in a media collecting ratio between the media advance speed and the media collecting speed different than one. In order to reduce the appearance of deficiencies, the speeds that have to be considered for the output roller and the drive roller are the peripheral speed, i.e., the linear speeds. In some examples, the peripheral speed of each of the rollers may be determined as a function of the angular speed of the roller and the radius of the roller.

In an example, when calculating a peripheral speed of the drive roller, a radius of the drive roller may be used to determine the peripheral speed based on the drive roller radius and the angular speed of the drive roller. However, when calculating the peripheral speed of the output roller, an output roller radius may vary based on the length of media collected on the output roller. Hence, depending on the overall amount of media on the output roller, the peripheral speed of the output roller may be different.

In some examples, a peripheral speed of the output roller may be determined based on a radius of the output roller determined during a decoupling operation. As previously explained, the media collecting operation results in a length of the medium on the output roller, thereby causing a radius increase. In order to determine the radius, an overall angular variation of the output roller may be measured with an encoder from the start of the media collecting operation (i.e. when collecting the first portion of the medium) up to collecting the second portion of the medium 222. Based on the measurements of the encoder, the controller may determine the radius of the output roller based on the overall angular variation of the output roller and the media advance distance during the decoupling operation. In an example, the media advance distance is determined by using a sensor to measure the advancement provided by the media advance engine of the printing system. In some examples, the radius of the output roller is determined with a function of the media movement (i.e., a measurement of the media advance over a time) and the overall angular variation of the output roller (i.e., a measurement of the angle rotated by the output roller over the time). By having the radius of the output roller available, the angular speed of the output roller may be modified such that the output roller collects the medium at a desired speed.

Although the speed profiles represented in FIG. 2 are linear, it should be understood that other speed profiles may be possible. In some examples, the printing system may comprise an encoder in order to define a closed-loop feedback system, wherein the speed of the media advance engine and/or the output roller are modified based on feedback provided by the encoder. In other examples, the encoder readings may be used to determine the radius of the output roller, and based on the radius, the linear speed of the media collecting operation may be determined.

Figure 3:
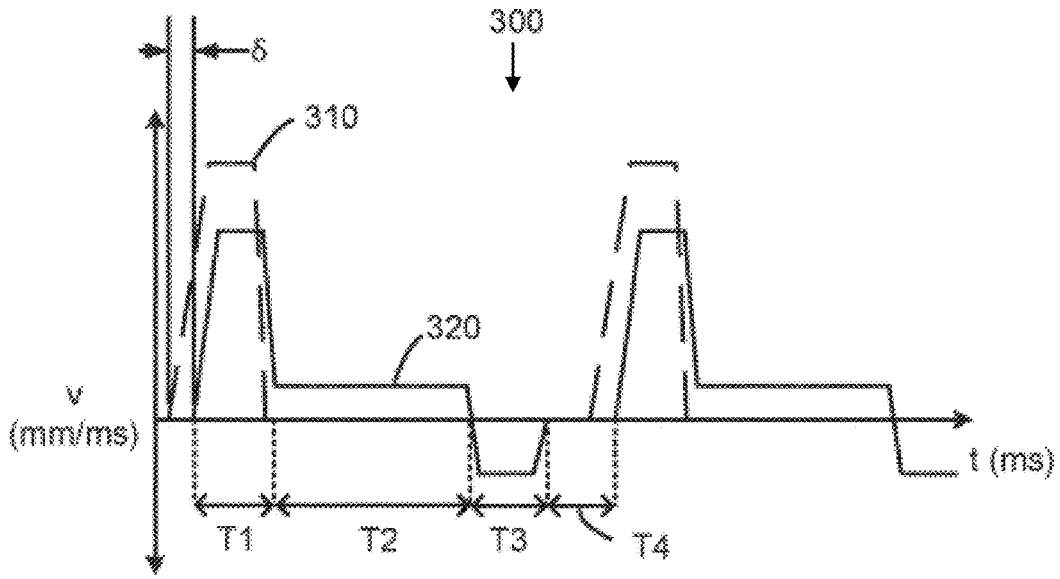
FIG. 3 shows a line chart representing a media collecting operation and a media advance operation, according to an example.

Referring now to FIG. 3, a line chart 300 representing a media advance speed 310 and a media collecting speed 320 is shown. The horizontal axis of line chart 300 represents a time and the vertical axis represents a linear speed. As previously explained in line chart 200 of FIG. 2, a decoupling between a media collecting operation and a media advance operation may be performed in order to reduce the negative impacts caused by the media collecting operation. In FIG. 3, the decoupling is obtained by collecting media on the output roller at a lower rate than the media advance transmitted to a medium by the media advance engine. Compared with the decoupling operation represented in line chart 200, line chart 300 further comprises delaying a movement of the output roller with respect to the media advance transmitted by the media advance engine and rewinding the output roller to release a length of medium previously collected around the output roller.

In the example of FIG. 3, the media advance speed 310 over a period T1 results in a first media advance. The speed profile of the media advance speed 310 over the period T1 comprises an acceleration, a media advance at a constant speed, and a deceleration. However, in other examples, alternative speed profiles may be possible, such as a profile comprising accelerating until reaching a speed and decelerating. After a delay δ has elapsed from the beginning of the first media advance, the output roller starts the media collecting operation. The delay δ enables to ensure that the media collecting operation does not result in a bad winding performance or other deficiencies experienced during a non-decoupled collecting operation. In an example, electronic delays may be possible when controlling the media advance speed 310 and the media collecting speed 320, and therefore, the introduction of the delay δ reduces the chances of collecting a distance of media in the output roller greater than a distance of media advanced by the media advance engine. In particular, in FIG. 3, the media collecting operation comprises collecting a first portion of the media advance at a first speed over the period T1, collecting a second portion at a second speed over a period T2, releasing a portion of media upon collecting the second portion over a period T3, and waiting a period T4 until a subsequent media collecting operation. In other examples, the subsequent media collecting operation may start immediately after the period T3, i.e., without waiting for the period T4.

Referring to the period T3, releasing a portion of the medium may further ensure that the output roller is decoupled from the media advance engine. Since the output roller radius increases over time based on at least one of the amount of collected media, dimensions of an output roller core, or media characteristics (such as the thickness of the medium), a rotation of the output roller in an unwinding direction releases the portion from the output roller. By releasing the portion, the media collecting operation prevents the collecting operation from deficiencies originated by tensions. In some examples, the portion may correspond to a backlash movement of the output roller, wherein the backlash movement comprises rewinding the output roller a predefined distance, i.e., rotating the output roller in the unwinding direction the predefined distance. In other examples, instead of rewinding a predefined distance, portion may correspond to a number of revolutions of the output roller, i.e., an angular variation instead of a distance variation transmitted by the output roller. Once portion has been released, during the period T4, the media collecting operation is halted and the output roller does not collect media from the media advance engine. Upon a subsequent media advance movement begins, the decoupled media collecting operation is performed.

In some examples, a printing system may comprise an encoder to measure an angle rotated by the output roller during the media collecting operation. Based on the measurement of the encoder and the media advance transmitted by the media advance engine, a radius of the output roller may be determined. In an example, the radius of the output roller may be a function of an overall medium advance over a time or an overall angle rotated by the output roller over the time. In order to consider the medium released during the period T3, the radius calculation may further comprise calculations based on a number of rewinding operations performed by the output roller. As previously explained, the rewinding operations (in FIG. 3 the released portion over the period T3), may comprise rotating the output roller a fixed angle value in an unwinding direction. In the example of FIG. 3, a first output roller radius may be determined upon the second portion is collected. Once the second portion is considered to be collected, a controller of the printing system may calculate the radius based on the first media advance and an angle rotated by the output roller over the periods T1 and T2. Then, a correction of the released portion may be performed. To perform the correction, the controller may determine an amount of medium released (for instance, a length of the medium) during the movement in the unwinding direction. In an example, the movement of the output roller in the unwinding direction corresponds with a fixed angular rotation of the output roller associated to a fixed angle value (for example, 90 degrees in the unwinding direction), and therefore, the amount of medium released (and hence the radius difference) can be determined In other examples, the radius determination may comprise calculating the radius based on an overall media advance distance over a period of time and an overall angle rotated by the output roller over the period of time.

According to some examples, a media advance transmitted by the media advance engine and a media collected by the output roller may be measured by sensors. However, in some other examples, the printing system may not comprise a sensor to measure the amount of medium collected by the output roller. Hence, in order to determine whether a portion of medium has been collected, alternative methods may be used. In an example, collecting the first portion of the medium on the output roller may comprise collecting media at the first speed over a pre-determined time. Therefore, although the media advance may be modified, collecting the first portion of the medium may collect the same amount of medium over the pre-determined time. Then, in order to determine if the second portion of medium has been collected, a controller may determine if a voltage applied to a motor for driving the output roller is exceeding a threshold voltage while maintaining a constant angular speed. Since a re-coupling between the media advance engine and the output roller results in a torque increase, the controller may associate such torque increase with a threshold voltage. Thus, if a motor driving the output roller exceeds such threshold voltage (i.e., a torque exerted by the motor has exceeded a threshold torque), the controller may determine that the second portion of medium has been effectively collected.

Figure 4:
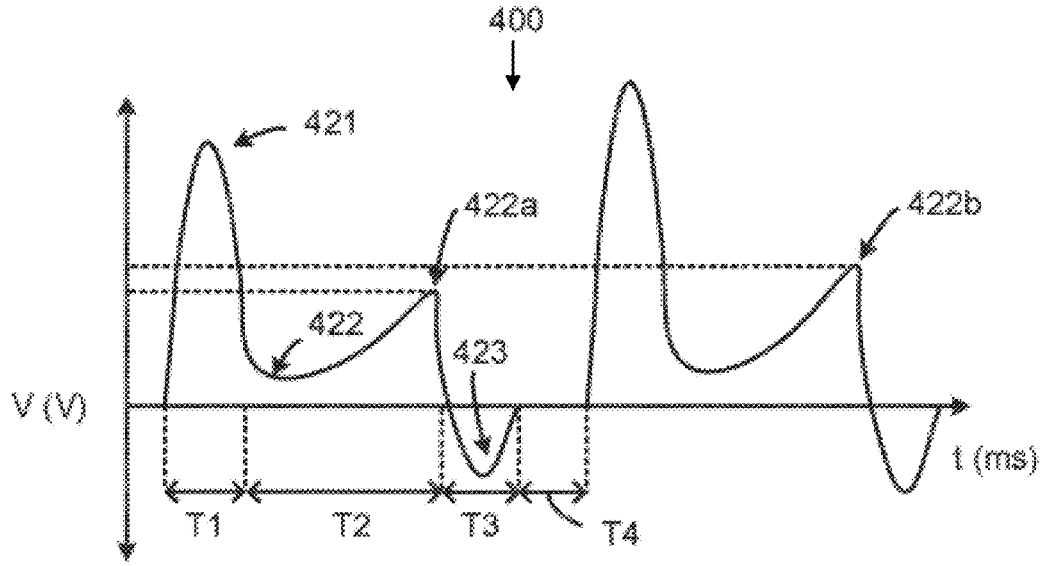
FIG. 4 shows a chart representing voltage values of a motor driving an output roller over a period of time, according to an example.

Referring now to FIG. 4, a chart 400 representing voltage values over a period of time is shown. The voltage values may correspond with input voltages at which a motor driving an output roller of a printing system is set. In particular, the voltage values represented in the chart 400 correspond with the voltage values obtained during the media collecting operation previously described in line chart 300, i.e., collecting the first portion of the media advance at the first speed over the period T1, collecting the second portion at the second speed over the period T2, releasing a length of the medium from the output roller after collecting the second portion over the period T3, and waiting the period t4 until the subsequent media collecting operation starts. For each of these operations, the motor driving the output roller is set at a voltage value. As a result, the output roller transmits a force to the medium. In case of having a medium exerting force against the rotation of the output roller while rotating the output roller at a speed, the output roller will have to exert an additional torque to keep the output roller rotating at the same speed. Therefore, since the printing system may determine the speed of the output roller with sensors but the amount of medium collected by the output roller may be unknown, the controller may determine if the medium has been collected based on the voltage values of the motor driving the output roller.

As explained above, the output roller collects a first portion of the medium over the period T1, the output roller collects a second portion of the medium over the period T2, the output roller rotates in an unwinding direction to release a portion of medium over the period T3, and the output roller does not rotate over the time T4. In order to perform the rotations, the motor driving the output roller is set at different voltage values. Over the period T1, the motor is set at a first voltage profile 421. The voltage profile 421 results in a media collecting acceleration, a steady media collecting speed, and a media collecting deceleration. Then, over the period T2, the motor is set at a second voltage profile 422 to collect media at the second speed. Since the amount of medium collected by the output roller increases, the second voltage profile 422 increases over the period T2 until reaching a first threshold voltage 422*a*. When reaching the first threshold voltage 422*a*, the controller of the printing system may determine that the second portion of the medium has been collected at the second speed. In an example, the first threshold voltage 422*a* may be associated with a threshold torque transmitted to the medium. If the threshold torque is exceeded, the media collecting operation may result in deficiencies. Once the first threshold voltage 422*a* is reached, the output roller decreases its speed until the rotation is stopped. Then, over the period T3, the media collecting operation comprises rotating the output roller in an unwinding direction to release a length of the medium previously collected by the output roller. In order to obtain such a movement, the motor is set at a third voltage profile 423. Upon the movement has been performed, the media collecting operation comprises waiting over the period T4 until a subsequent media collecting operation starts.

As previously explained, the media collecting operation results in a length of the medium being collected in the output roller. Over time, the collected media results in a weight increase of the output roller, and an increase in the radius of the output roller. In order to correct the impact of the increases, the threshold voltage at which the collected media is considered to be effectively collected may be periodically determined. In an example, the threshold voltage is determined based on a series of parameters such as the type of media being collected and an amount of medium on the output roller. Based on the type of media, the controller of the printing system may determine a correction factor representing how much increases the radius of the output roller in each time revolution of the output roller. Similarly, the amount of medium on the output roller may be used to determine the threshold voltage. In order to determine such amount of medium, the controller may determine the amount of medium on the output roller as the media advancement provided by the media advance engine less the movement in the unwinding direction provided over the period T3. Since the movement in the unwinding direction may be a predefined angular value (for instance half a revolution), the controller may determine a media length collected by the output roller. For example, in the chart 400 of FIG. 4, a second threshold value 422*b* is different from the first threshold value 422*a*. Due to the amount of medium collected over the periods T1 to T4, the second threshold value is greater than the first threshold value 422*a*.

According to some examples, the media collecting operation may be performed while a print engine of the printing system is performing a printing operation over a medium. Nonetheless, in some examples, the media collecting operation may be performed during an idle time of the printing system, i.e., when the printing system is not performing a printing operation over the medium. Accordingly, the decoupling between the media advance engine and the output roller may be performed at different times based on type of printing operation being performed by the printing system. For instance, in some examples, the decoupling operation may be executed based on a number of print swaths has been performed over the medium. In order to prevent printing artifacts, the media collecting operation may be deferred until the printing operation has finished. In other examples, the media collecting operation may be performed while the printing operation is being performed. Nonetheless, in order to prevent printing artifacts, a larger buffer may be created and different second speeds may be used to collect media on the output roller. In some other examples, the media collecting operation may be performed upon the media advance engine has advanced the medium for a determined distance (for instance, one meter). Upon a sensor determines that the media advance engine has advanced the medium for the determined distance, the controller of the printing system may start the media collecting operation.

Figure 5:
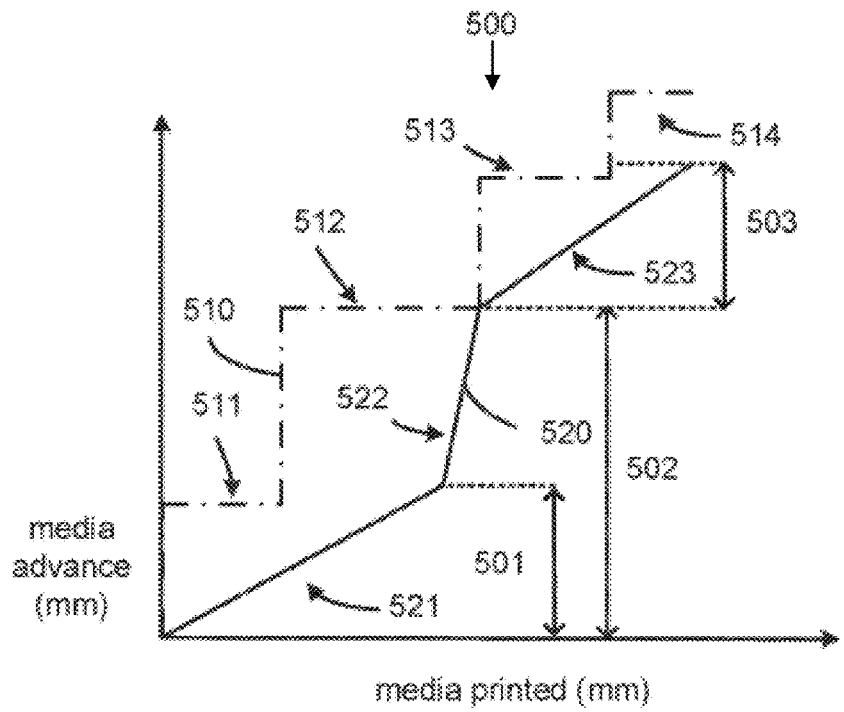
FIG. 5 shows a line chart representing a distance of collected media and a distance of media advance over a distance of media printed, according to an example.

Referring now to FIG. 5, a line chart 500 representing a media advance 510 and a collected media 520 is shown. The X-axis of the line chart 500 represents a distance of medium printed and the Y-axis represents an advance distance of the medium. The medium may be printed, for instance, by a print engine of the printing system. A medium may be advanced, for instance, by using a media advance engine such as a drive roller. As previously explained, the decoupling between the media advance 510 and the collected media 520 may be performed either while the printing operation is being performed or while no printing operation is being performed. Similarly, the decoupling may be performed either when the media advance 510 does not increase or when the media advance 510 is increased.

It should be noted that although the line chart 500 represents both the media advance 510 and the collected media 520 over the same horizontal axis (i.e., the distance of media printed), the values represented on the axis should be understood as values identifying a state of a printing operation, i.e., the distance of media printed is not printed twice. Instead, the line chart 500 is representing a relationship between two variables identifying a state of a printing system: the media advance and the distance of media printed.

In the line chart 500, the media collecting operation is performed while the media advance 510 is increased, i.e., the decoupling operations and the subsequent re-coupling operations are performed while the media advance 510 is increasing. As a result, the idle times of the output roller are decreased, and consequently, the throughput of the printing system (at least in terms of the media collecting operation) increases. In particular, the media advance 510 comprises four stages: a first media advance stage 511, a second media advance stage 512, a third media advance stage 513 and a fourth media advance stage 514. Similarly, the media collecting operation comprises a first media collecting stage 521, a second media collecting stage 522, and a third media collecting stage 523.

As previously described in other examples, the media collecting operation comprises collecting a first portion of a determined medium length at a first speed and collecting a second portion of the determined medium length at a second speed. In line chart 500, the determined medium length corresponds with a determined media advance 502. Accordingly, the first portion of the determined media advance 502 corresponds to a first length 501. The determined media advance 502 may have been previously defined based on predefined values or may be dynamically defined based on the printing operation. Similarly, the first length 501 may be defined as a percentual value of the determined media advance 502 (for instance a value within the range from 40% to 75% of the determined media distance 502). During the first length 501, the media collecting operation is to be performed under certain conditions such as the first media collecting stage 521 until the collected media 520 reaches the first length 501. Then, the media collecting operation is performed under different conditions until the collected media 510 reaches the determined media advance 502. As explained above, the difference between the first media collecting stage 521 and the second media collecting stage may be a decrease of the speed of the output roller from a first speed to a second speed, wherein the second speed is lower than the first speed.

In the example of FIG. 5, the media advance 510 comprises the first media advance stage 511, the second media advance stage 512, the third media advance stage 513 and the fourth media advance stage 514. During the first media advance stage 511, at first, the media is advanced for a distance and then, a distance equal to the media advance distance is printed. During the second media advance stage 512, at first, the medium is advanced for a second distance and then, a distance equal to the media advance (i.e., the second distance) is printed. However, since the second distance resulting from the second media advance stage 512 is greater than the first distance resulting from the first media advance stage 511, the printed distance in the second media advance stage 512 is greater than the printed distance in the first media advance stage 511. However, due to the second media collecting stage 522 is to be performed until an amount of collected media reaches the determined medium length 502, a greater printed distance does not affect in the media collecting operation. Rather, since the media collecting operation is executed based on the media advance (and not the distance of media printed), the decoupling operation may be performed in the printing system even though no media is being printed.

Upon the first decoupling operation has been performed, the third media advance stage 513 and the fourth media advance stage 514 are performed. For each stage, the printing system advances the medium and subsequently prints on the medium. While performing the fourth media advance stage 514, the third media collecting stage 523 exceeds a second length 503. The third media collecting stage 523 comprises a greater slope than the first media collecting stage 521. In an example, increases and decreases in the slope of the media collecting stages may be defined based on a remaining distance of media printed. Hence, in case of having a shorter distance of media printed, since the decoupling operations are based on the media advance rather than the distance of printed media, the slope of the media collecting stage increases.

In an example, the media advance stages 511, 512, 513 and 514 may be replaced with media advance stages having alternative profiles. For example, the media advance stage may comprise advancing a media while printing on such a media at the same time. As a result, instead of having a stepped profile defined by vertical lines and horizontal lines, the media advance stages may be represented by tilted lines.

Figure 6:
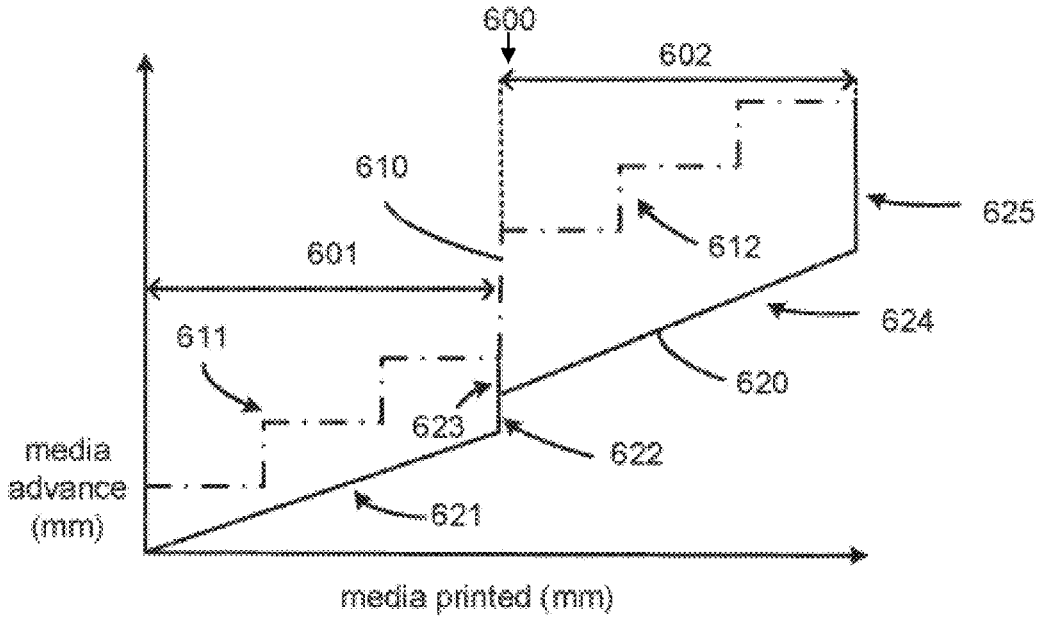
FIG. 6 shows a second line chart representing a distance of collected media and a distance of media advance over a distance of media printed, according to an example.

Referring now to FIG. 6, a line chart 600 representing media advance 610 and collected media 620 is shown. The X-axis represents a distance of media printed on a medium and the Y-axis represents a media advance of the medium. The media advance 610 comprises a first media advance stage 611 and a second media advance stage 612. In each media advance stage, a series of media advances and a series of printing operations are performed. In particular, since the first advance stage 611 and the second advance stage 612 comprise a stepped profile, the printing operation performed over the media is performed while the media is not being advanced. Accordingly, during a media advance, no media is being printed. In an example, the first advance stage 611 and the second advance stage 612 correspond with a series of print swaths. While the media advance 610 is being performed, an output roller performs a media collecting operation. As a result of the media collecting operation, a portion of the medium is collected. To collect the medium, the media collecting operation comprises a first media collecting stage 621, a second media collecting stage 622, a third media collecting stage 623, a fourth media collecting stage 624, and a fifth media collecting stage 625. In other examples, the media collecting operation may be deferred with respect the media advance operation.

As explained above, a media collecting operation may be performed based on a media advance (as previously explained in reference to FIG. 5) or a distance of media printed. In line chart 600, the media collecting operation is performed based on the distance of media printed. In particular, a first decoupling operation is performed during a first printed distance 601 and a second decoupling operation is performed during a second printed distance 602. In order to reduce deficiencies caused by the media collecting operation, the media collecting operation collects a first portion of the medium at a first speed when the printing operation is being performed and collects a second portion of the medium at a second speed while no printing operation is being executed over the media. As a result, the collected media 620 comprises vertical lines that represent an increase or decrease of the collected medium without printing. More precisely, the second media collecting stage 622 and the fifth media collecting stage 625 comprise collecting a distance of the medium and the third media collecting stage 623 comprises releasing a distance of the medium from the output roller. As previously explained in FIGS. 3 and 4, examples of media collecting operations may comprise rotating the output roller in an unwinding direction to prevent the media collecting operation from deficiencies. However, in other examples, the media collecting operation be performed without a rotation of the output roller in the unwinding direction, i.e., without the third media collecting stage 623.

In the example of FIG. 6, the first decoupling operation is performed over a time during which the first printed distance 601 is being printed. The first decoupling operation comprises the first collecting stage 621, the second collecting stage 622, and the third collecting stage 623. As previously described, the first collecting stage 621 and the second collecting stage 622 comprise collecting portions of the medium at different speeds. During the first collecting stage 621, a first portion of the medium is collected at a first speed. During the second collecting stage 622, a second portion of the medium is collected at a second speed, the second speed being lower than the first speed. In some examples, the first speed is five times greater than the second speed. However, alternative ratios may be possible. In line chart 600, the first decoupling operation is followed by the second decoupling operation. As previously explained, a delay may be added between the decoupling operations. The second decoupling operation comprises the fourth media collecting stage 624 and the fifth media collecting stage 625. During the second decoupling operation, the output roller collects an additional length of the medium when compared with the first decoupling operation. However, since the criterion for the decoupling operation is the printed distance and not the media advancement, the media collecting operations are based on printed distances.

Although in line chart 600 the second collecting stage 622, the third collecting stage 623, and the fifth collecting stage 625 are represented as vertical lines, in other examples such collecting stages may be tilted lines. Accordingly, the first printed distance 601 and the second printed distance 602 may be divided into additional distances, wherein the additional distances define each of the collecting stages. Similarly, although the first advance stage 611 and the second advance stage 612 correspond with a stepped profile, in other examples alternative profiles comprising tilted lines may be possible (i.e., printing media and advancing media simultaneously).

Figure 7:
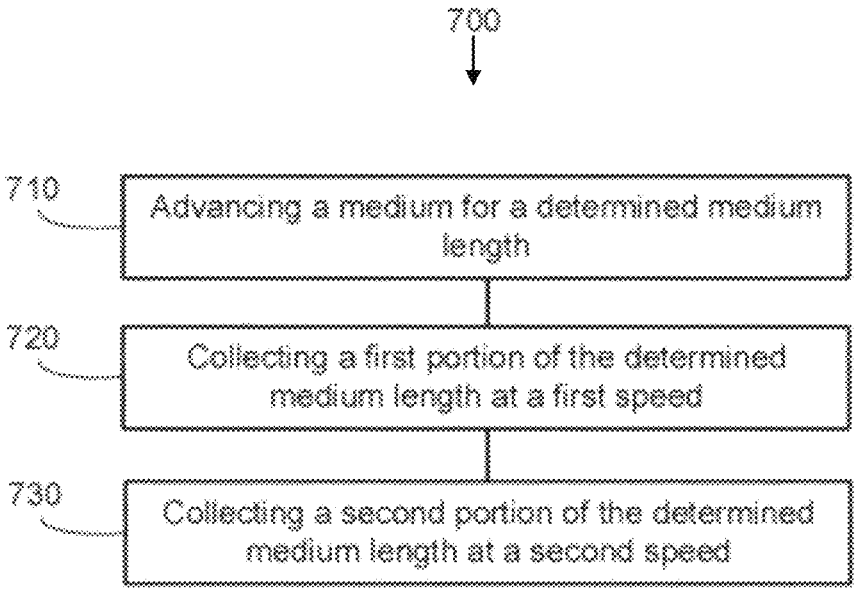
FIG. 7 shows a method to wind media in an output roller, according to an example.

Referring now to FIG. 7, a method 700 to wind media in an output roller downstream a drive roller is shown. The output roller and the drive roller may correspond with the output roller 120 and the media advance engine 110 described previously in reference to the printing system 100 represented in FIG. 1. As previously explained, the media advance engine 110 may comprise a drive roller to engage with a medium. Nonetheless, alternative systems may be used to drive the medium towards the output roller, such as belts. At block 710, method 700 comprises advancing a medium for a determined medium length. The medium may be advanced, for instance, by rotating a drive roller of a printing system. As previously explained, the determined length may correspond with a length of media advance or a length of media printed associated with a series of print swaths. At block 720, method 700 comprises collecting a first portion of the determined medium length at a first speed. To collect the first portion of the determined medium length, the output roller rotates in a winding direction at an angular speed. Since the radius of the output roller incrementally increases during the media collecting operation, a same angular speed may provide different linear speeds based on the amount of medium collected on the output roller. In some examples, block 720 may be deferred with respect to block 710 in order to ensure that a decoupling of the media is being effectively performed, i.e. method 700 comprises delaying the collecting of the first portion and the second portion of the determined medium length is deferred with respect to the advancing of the media. Then, at block 730, method 700 comprises collecting a second portion of the determined medium length at a second speed. To collect the second portion of the medium, the output roller rotates in the winding direction at an angular speed such that the medium is collected at a second speed. In order to reduce the deficiencies caused by an excessive media collecting speed, the second speed is lower than the first speed.

In an example, method 700 may further comprise determining a radius of the output roller. In order to calculate the radius, method 700 may further comprise measuring with a sensor an angle rotated by the output roller and, upon collecting the second portion of the determined medium length, determining a radius of the output roller as a function of the angle rotated and the determined medium length. In other examples, method 700 may further comprise comparing the determined radius to a maximum radius value and triggering a signal upon the determined radius of exceeds the maximum radius value for the output roller.

In some examples, method 700 may further comprise releasing collected media from the output roller after the output roller has collected the second portion of the media advance (block 720), wherein the release is obtained by rotating the output roller in an unwinding direction. In an example, rotating the output roller in the unwinding direction comprises rotating the output roller for a determined angle.

In some other examples, method 700 may comprise detecting that the second portion of the medium has been collected based on a voltage value of a motor driving the output roller. As previously explained in FIG. 4, the collecting of the second portion of media may be considered to be performed based on a voltage value reading. In an example, collecting the second portion the determined medium length (block 720) further comprises determining a voltage of a motor driving the output roller, comparing the voltage to a threshold voltage, and stopping the output roller rotation upon the voltage exceeds the threshold voltage. As result, the appearance of excessive tensions generated by the re-coupling is prevented. In other examples, the method may comprise determining a power instead of a voltage. In some other examples, the threshold voltage may be determined based on at least one of a type of medium being collected, a radius of the output roller, and an amount of medium (for instance, a length of media) on the output roller. The radius of the output roller may be determined, for instance, as a function of the media advance length and the angle rotated by the output roller to collect the media advance length.

According to an example, a computer-readable medium may comprise instructions that, when executed a processor, cause a system to execute a decoupling operation. Examples of computer-readable mediums comprise any non-transitory tangible medium that can embody, contain, store, or maintain instructions for use by a processor. Computer-readable media include, for example, electronic, magnetic, optical, electromagnetic, or semiconductor media. More specific examples of suitable computer-readable media include a hard drive, a random access memory (RAM), a read-only memory (ROM), memory cards and sticks, and other portable storage devices.

Figure 8:
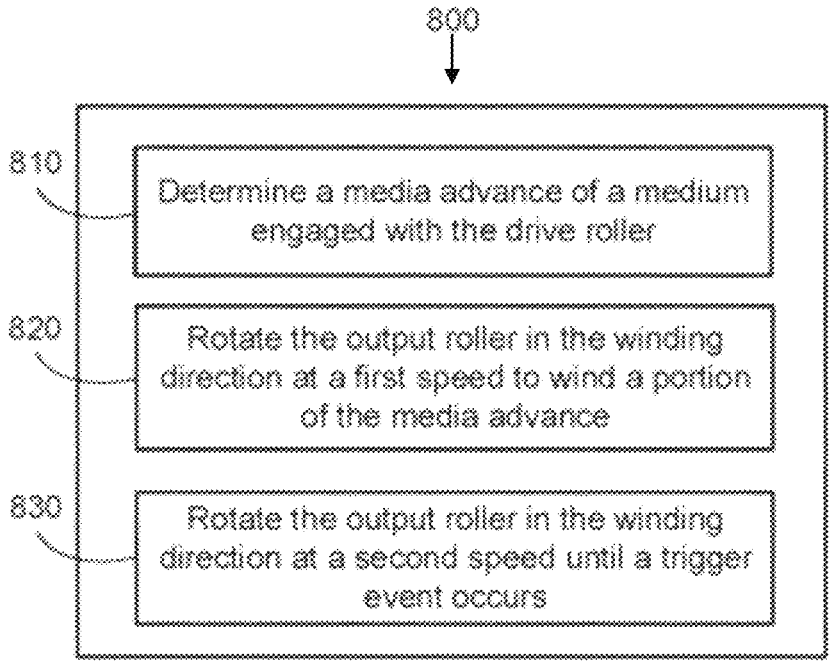
FIG. 8 shows a computer-readable medium comprising instructions, according to an example.

Referring now to FIG. 8, a computer-readable medium 800 comprising a set of instructions is shown. The instructions, when executed by a processor (not shown in FIG. 8), cause a system comprising a drive roller upstream an output roller to execute a series of actions. In FIG. 8, the set of instructions comprise a first instruction 810, a second instruction 820, and a third instruction 830. The first instruction 810, when executed by the processor, cause the system to determine a media advance of a medium engaged with the drive roller. The media advance may be determined, for instance, with a sensor such as an encoder. In an example, the encoder may determine an angle rotated by the drive roller over a time, and based on the radius of the drive roller and the angle rotated, the media advance may be determined as a function of the angle rotated over the time and the radius of the drive roller. The second instruction 820, when executed by the processor, causes the system to rotate the output roller in the winding direction at a first speed to wind a portion of the media advance. In an example, the second instruction 820 may further cause the system to delay the rotation of the output roller with respect to the media advance. In an example, the first speed at which the output roller is rotated may be determined based on a media advance speed transmitted to the medium by the drive roller (for instance, the first speed corresponds to a percentual value of the media advance speed in the range of 40% to 80%). In other examples, the first speed may be set at a predefined value and a media collecting time may be modified based on the media advance transmitted by the drive roller. In other examples, the rotation in the winding direction at the first speed may be performed until reaching a percentual value of the media advance transmitted by the drive roller. As a result, if the percentual value is set at 60% and the media advance is 1 meter, the output roller will rotate in the winding direction at the first speed until 60 centimeters of media are collected on the output roller.

The third instruction 830 of the computer-readable medium 800, when executed by the processor, causes the system to rotate the output roller in the winding direction at a second speed until a trigger event occurs, wherein the first speed is greater than the second speed. In some examples, the set of instructions may further cause the system to measure a speed of the output roller with a speed sensor. For example, the third instruction 830 may comprise further instructions to measure a speed of the output roller with a speed sensor, determine a speed difference between the second speed and the measured speed, and modify a voltage of a motor of the output roller based on the speed difference.

In some examples, the computer-readable medium 800 may comprise further instructions to cause the system to control an output roller speed correction based on a voltage value and a current angular speed. In an example, rotate the output roller in the winding direction at the second speed until the trigger event occurs (third instruction 830) further comprises measure a speed of the output roller based on a reading of a sensor, determine a speed difference between the second speed and the measured speed, and modify a voltage of a motor of the output roller based on the speed difference. In some examples, the processor of the system may determine the radius of the output roller and, based on the determined radius and an output roller angular speed determined by the sensor, the media collecting speed may be determined.

In some examples, the computer-readable medium 800 may comprise further instructions to cause the system to rotate the output roller in an unwinding direction a predefined distance such as a fixed angle value. As previously explained in FIGS. 3 and 4, the rotation in the unwinding direction enables to release a length of media from the output roller, thereby ensuring that subsequent media collecting operation does not impart excessive tensions towards the media being collected.

In other examples, the trigger event may be at least one of a maximum voltage value and a maximum angular value. In an example, the trigger event corresponds with least one of the actions of modifying a voltage of motor driving the output roller over a maximum voltage and reaching a maximum angular value with the output roller, wherein the maximum rotated value is based on the remaining is based on a remaining portion of the media advance of the media and a predefined distance rotated in the unwinding direction. However, if the decoupling operation does not comprise a rotation of the output roller in the unwinding direction, the maximum angular value is based on the remaining portion of the media advance.

As previously explained, the radius of an output roller may be determined based on a rotation of the output roller over a media advance of a media. In some examples, a radius of the output roller may be determined, and upon determination, compared to a maximum radius value. If the determined radius exceeds the maximum radius value, a replacement signal may be triggered. In some examples, the computer-readable medium 800 may comprise further instructions to cause the system to determine with a sensor an angular speed of the output roller, upon the trigger event occurs, determine a radius of the output roller based on the angular speed and the media advance of the media, and trigger an error if the radius of the output roller exceeds a maximum radius value.

What has been described and illustrated herein are examples of the disclosure along with some variations. The terms, descriptions, and figures used herein are set forth by way of illustration only and are not meant as limitations. Many variations are possible within the scope of the disclosure, which is intended to be defined by the following claims (and their equivalents) in which all terms are meant in their broadest reasonable sense unless otherwise indicated.

What is claimed is:

1. A printing system comprising:

a drive roller to advance a medium towards a print engine at a first speed;

an output roller downstream the drive roller to receive the medium; and a controller to:

advance the medium for a determined medium length by a rotation of the drive roller;

rotate the output roller in a winding direction at a second speed while the drive roller advances the medium, the second speed being lower than the first speed; and subsequently, rotate the output roller in the winding direction at a third speed while the drive roller does not advance the medium, the third speed being lower than the second speed.

2. The printing system of claim 1, the printing system further comprising the print engine to execute a printing operation and wherein the determined medium length is a length associated with a set of print engine swaths, wherein the controller is to:

control the print engine to execute the printing operation on the medium once the medium is advanced the determined medium length.

3. The printing system of claim 1, wherein the third speed is five times lower than the second speed.

4. The printing system of claim 1, wherein the controller is further to:

determine a voltage of a motor driving the output roller during the rotation at the third speed;

compare the voltage to a threshold voltage; and rotate the output roller in an unwinding direction upon the voltage exceeds the threshold voltage.

5. The printing system of claim 1, wherein:

the output roller rotation at the second speed collects a first portion of the determined medium length, and the output roller rotation at the third speed collects a second portion of the determined medium length, the first portion being at least two times greater than the second portion.

6. The printing system of claim 1, the printing system further comprising the print engine to execute a printing operation, wherein the controller is to:

control the print engine to execute the printing operation on the medium during the media advancement.

* * * * *